United States Patent [19]

Niles et al.

[11] 4,253,234

[45] Mar. 3, 1981

[54] METHOD OF MAKING ELECTRICAL CONTACT

[75] Inventors: Paul D. Niles, Bainbridge; Richard W. Normann, Otego, both of N.Y.

[73] Assignee: The Bendix Corporation, Southfield, Mich.

[21] Appl. No.: 973,272

[22] Filed: Dec. 26, 1978

Related U.S. Application Data

[62] Division of Ser. No. 910,975, May 30, 1978.

[51] Int. Cl.[3] ..... H01R 43/04

[52] U.S. Cl. ..... 29/882; 29/876

[58] Field of Search ..... 29/629, 630 A, 628, 29/872, 882; 300/21

[56] References Cited

U.S. PATENT DOCUMENTS

| | | | |
|---|---|---|---|
| 2,093,198 | 9/1937 | Kleinmann | 300/21 X |
| 2,861,324 | 11/1958 | Klumpp, Jr. | 29/630 A |
| 3,163,485 | 12/1964 | Kruitwagen et al. | 29/630 A |
| 3,243,763 | 3/1966 | Elliott | 29/630 A X |
| 3,455,022 | 7/1969 | Schmitz, Jr. | 29/629 |
| 3,648,224 | 3/1972 | McDonough | 29/629 X |
| 3,725,844 | 4/1973 | McKeown et al. | 339/108 TP X |
| 3,728,787 | 4/1973 | McDonough | 29/629 |

*Primary Examiner*—Charlie T. Moon
*Assistant Examiner*—C. J. Arbes
*Attorney, Agent, or Firm*—Kenneth A. Seaman; Raymond J. Eifler; Charles D. Lacina

[57] ABSTRACT

A method of making an electrical contact wherein the contact includes a plurality of axially aligned wires (200) extending from a forward end (110) of a holder which has a rear portion (130) for receiving an electrical conductor (300). The holder (100) is manufactured by stamping it as a flat metallic piece with enlarged forward and rear portions then forming the forward portion (110) in a die to form a socket like portion for the plurality of fine, axially aligned wires and forming the rear portion (130) to receive the conductor (300).

8 Claims, 11 Drawing Figures

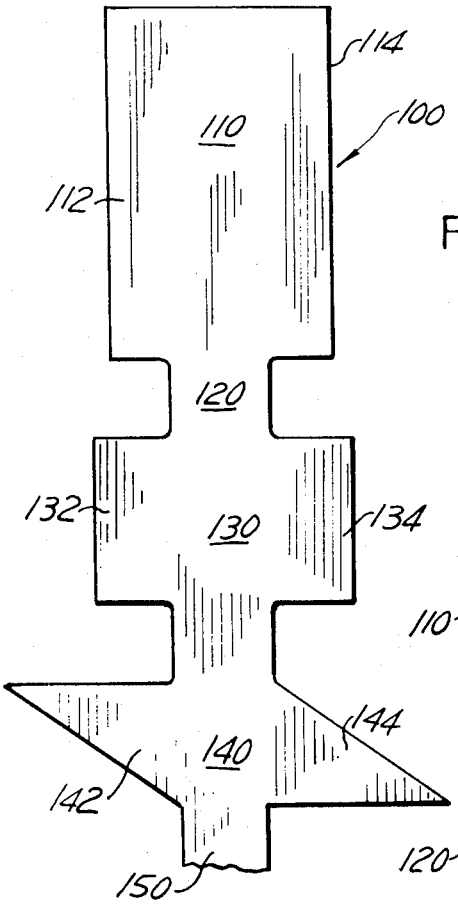
FIG. 1
FIG. 9
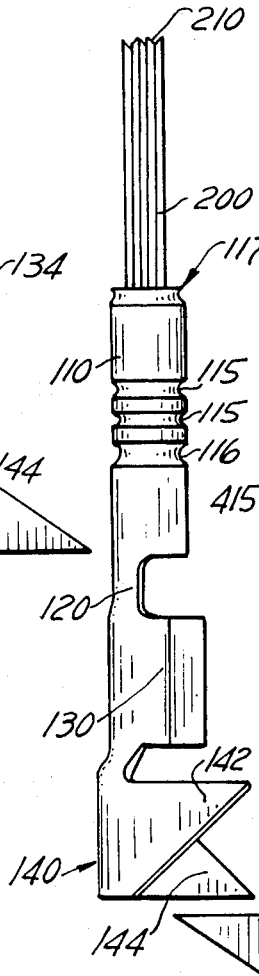
FIG. 11
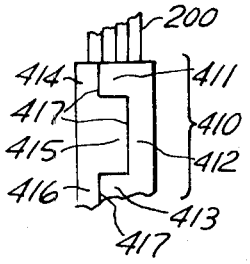
FIG. 10
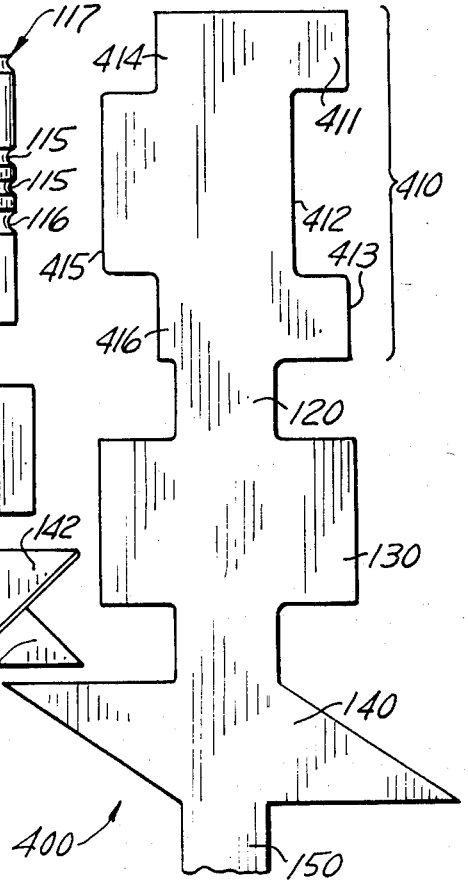

METHOD OF MAKING ELECTRICAL CONTACT

This is a division, of application Ser. No. 910,975, filed May 30, 1978.

CROSS REFERENCE TO RELATED PATENTS

U.S. Pat. No. 3,725,844 issued to McKeown et al. for "Hermaphroditic Electrical Contact", herein incorporated by reference and subsequently referred to as the "Brush Contact Patent".

U.S. pending patent application Ser. No. 863,366 filed Dec. 22, 1977 by R. W. Normann et al. for "Electrical Connector Contact and Method of Making", herein incorporated by reference and subsequently referred to as the "Welded Brush Contact Patent".

TECHNICAL FIELD

The present invention relates to a novel electrical contact and a novel method for making it. More particularly, the present invention relates to an electrical contact holder which is made by stamping a flat metallic stock in an appropriate shape with an enlarged foward portion, then forming the enlarged portion to make a socket for receiving a plurality of contact wires which are secured within the holder.

BACKGROUND ART

Prior art electrical contacts are well known which have a plurality of fine, axially aligned wires (sometimes called "brush wires") extending from one end of a holder which is adapted to receive a conductor in a socket in the other end. In such applications, one of which is disclosed in the Brush Contact Patent, the holder is made from a cylindrical stock with holes drilled from either end to form two sockets, the forward one for the brush wires and the rear one for the conductor.

The insertion of a conductor into the rear socket can not presently be accomplished with automated equipment and is generally accomplished by hand at a relatively higher expense than if the conductor could be inserted into and fixed within the contact by automated equipment.

The drilling of holes in such a holder requires precise positioning of the drill for the holes to provide a wall which has uniform thickness to give good performance, yet is thin enough to be crimped to maintain the wires therein.

Furthermore, the drilling operation is itself undesirable in that it adds expense to the manufacturing process and further requires that additional machining capacity, machine operators and transfer of parts.

The contact described in the Brush Contact Patent further contemplated that each holder be separately and individually handled during manufacturing and assembly. Such separate handling is time consuming and expensive.

The contact described in the Brush Contact Patent also requires that the sockets be plated with a plating solution to improve the electrical characteristics. This plating is an extra step, and furthermore, it requires in some applications that vents or exit holes be drilled transversely into the socket to allow the plating solution to be removed from the socket.

The electrical contacts described in the Welded Brush Contact Patent have similar sockets drilled into cylindrical stock and thus have similar limitations and undesirable features.

Accordingly, there are undesirable features and limitations of the prior art contacts.

SUMMARY OF THE INVENTION

The present invention overcomes the undesirable features and limitations of the prior art by providing a contact for an electrical connector which is less expensive and may, in some instances, be of a higher quality than the electrical contacts which are manufactured by other methods. Further, the present method allows a more mechanized manufacture of a contact which requires less labor, handling and transporting of parts during manufacturing. The electrical contact of the present invention allows several contacts to be handled together to reduce costs.

Accordingly, the present invention is an electrical connector contact which may use automated equipment advantageously to produce contact with low manufacturing cost.

The present contact is also desirable in that stock pre-plated with an electrically conducting material can be used in place of the plating by a plating solution. The use of preplated stock not only eliminates the step of plating but also the necessity of vent or exit holes to be drilled.

The present invention is a contact and manufacturing method in which the holder (100) of the electrical contact is manufactured by stamping it from a flat piece of metallic stock to have enlarged forward (110) and rear portions (130) and then forming the sides (112, 114) of the forward portion (110) up to form a socket for receiving a plurality of axially aligned electrical contact wires (200). The rear portion (130) is formed into a trough-like shape for receiving an electrical conductor (300). A conductor may be placed in the trough by automated equipment and thereafter the rear portion (130) crimped around the conductor to secure the conductor to the contact with optionally additional portions (142, 144) rearward of the rear portion (130) crimped around the insulation (310) of the conductor (300) to better secure the conductor.

Accordingly, the present invention is a method of making a contact to which an electrical conductor may be simply, quickly, cheaply and mechanically attached. The contact may be made cheaply and in an automated way with good quality and without requiring a drilling operation.

Other objects and advantages of the present invention will become apparent to one skilled in the art in view of the following description and drawings and the appended claims.

BRIEF DESCRIPTION OF THE DRAWINGS

FIG. 1 is a front view of an electrical contact holder of the present invention after the holder is stamped into a flat shape.

FIG. 3 is a cross-sectional view of the contact holder of FIG. 2, taken along the line III—III looking in the direction of the arrows.

FIG. 4 is a cross-sectional view of the contact holder of FIG. 2, taken along the line IV—IV looking in the direction of the arrows.

FIG. 5 is a cross-sectional view of the contact holder of FIG. 2, taken along the line V—V looking in the direction of the arrows.

FIG. 6 is a cross-sectional view of the contact holder of FIG. 2, taken along the line VI—VI looking in the direction of the arrows.

FIG. 7 is a cross-sectional view of the contact holder of FIG. 2, taken along the line VII—VII looking in the direction of the arrows.

FIG. 8 is a cross-sectional view of the contact holder of FIG. 2, taken along the line VIII—VIII in FIG. 2, looking in the direction of the arrows.

FIG. 9 shows a view of a completed electrical contact before a conductor has been connected thereto.

FIG. 10 shows an alternate structure for the stamped holder of FIG. 1.

FIG. 11 is a partial front view of the finished holder of the alternate holder structure of FIG. 10.

DETAILED DESCRIPTION OF THE DRAWINGS

Figure 2:
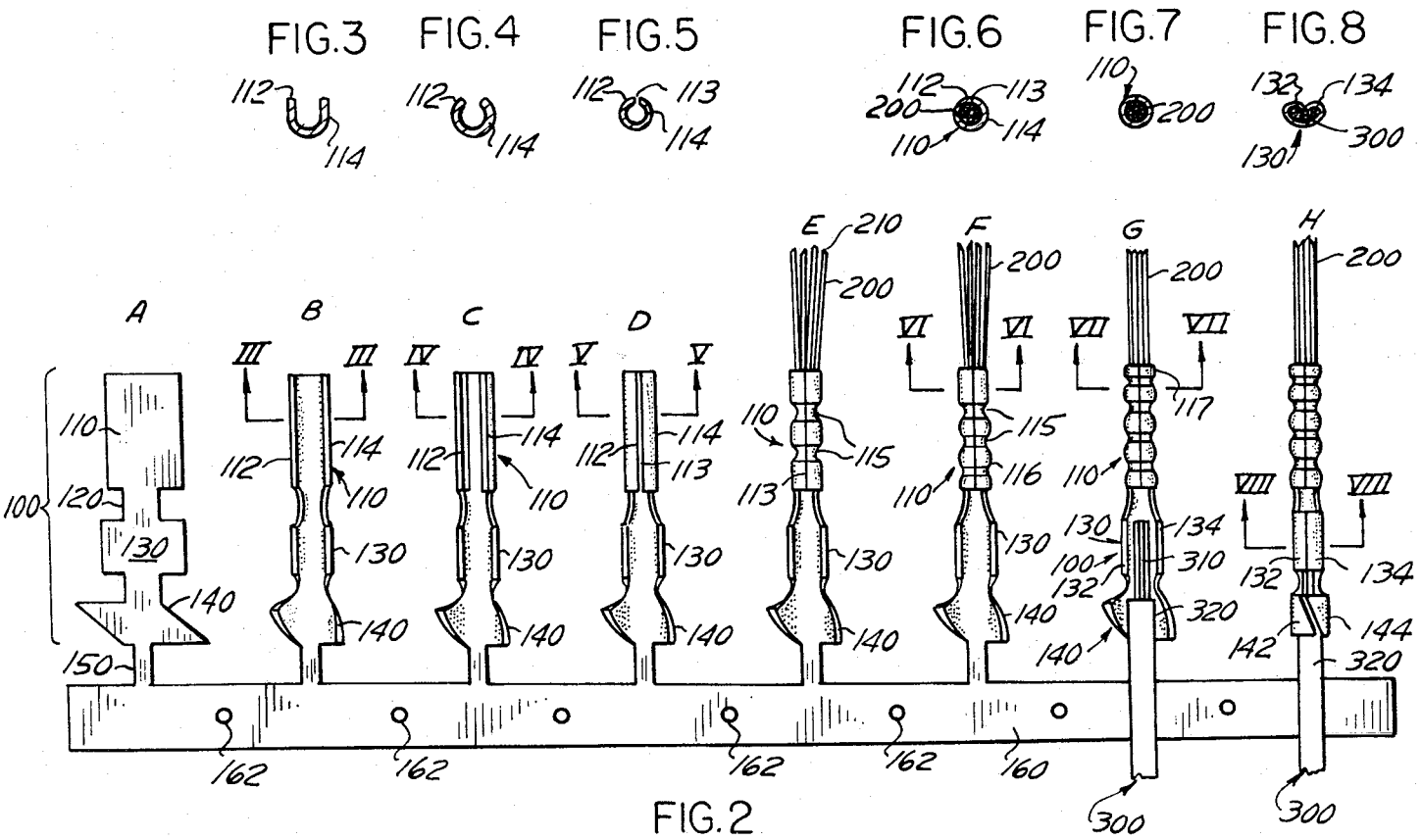
FIG. 2 shows the sequence of manufacturing and assembly steps for forming the holder from the flat piece of FIG. 1 into a electrical contact.

FIG. 1 is a view of a brush contact holder 100 which has been stamped from a flat stock, before the holder has been formed into a three-dimensional holder. The stamped holder 100 includes a forward portion 110, which will become a forward socket for axially aligned brush contact wires.

The forward portion 110 is connected by a necked down or relatively narrower portion 120 to a second portion 130 which will be a socket for receiving an electrical conductor. A portion 140 of the holder is formed for gripping the insulation of the conductor. A carrier strip attachment 150 attaches the holder 100 to a carrier strip (not shown).

The forward portion 110 has sides 112, 114. The rear portion 130 includes sides 132, 134. The insulation gripping portion 140 includes triangular portions 142, 144.

FIG. 2 shows the steps in the manufacture of the brush contact from a thin, flat stock of electrically-conducting material. A single flat holder is stamped from a strip (i.e., flat strip stock) and then each flat holder is formed progressively in steps as the holder moves through the die stations into the desired three-dimensional shape.

The flat strip stock which is used is preferably a copper-based alloy pre-plated with a material, such as tin, which either resists oxides and salts or which produces soft, friable oxides. Tin plating is relatively cheap while producing performance results which are acceptable for most uses. Where superior results are desired, a gold plating could be used. Another acceptable material is stock which has an inlaid strip or is clad with a similar conducting material in one or more strategic locations (i.e., the forward and/or rear sockets or a portion thereof.) The plated or clad or inlaid portion is placed on the side of the flat stock which will become the inside portion when the contact is rolled.

The holders 100 in various stages of completion are mounted to a carrier strip 160 which includes pilot holes 162 to allow the carrier strip 160 and holders 100 to be advanced from one station to the next in the die.

At the die position A, corresponding to the first die station, the holder 100 has been stamped as a flat piece which includes the holder portions 110, 120, 130, 140. The holder 100 is connected by a carrier strip attachment 150 to the carrier strip 160. The holder is flat (i.e., substantially one dimensional) at this stage.

At die position B, corresponding to the second die station, the die has formed or molded the three portions 110, 130, 140 upward and out of the plane (or single dimension) in which the holder 100 was at the die position A. The sides 112, 114 of the forward portion 110 of the holder extend at approximately a 90° angle upward from the plane in which the holder had been stamped at this stage. The three formed portions 110, 130, 140 are generally trough shaped at this stage.

At the die position C, the sides 112, 114 of the forward portion 110 of the holder have been bent or rolled further by the die, with the sides 112 and 114 being directed toward each other, but not completely together. The portions 130, 140 are not significantly formed at this position from their form the die at position B.

At the die position D, the outside edges of the sides 112, 114 of the forward portion have been guided into adjacent, almost abutting positions to form a sleeve or bottomless socket. The edges of the sides 112, 114 meet at an open seam 113 which extends the length of the forward portion on sleeve. The open seam 113 allows a small clearance for ease in inserting the brush wires, although it may not be necessary in some applications.

At the die position E, a plurality of thin, straight, generally axially aligned wires 200, each with acutely angled forward end surfaces 210, have been inserted into the forward socket or sleeve portion 110 and crimps 115 have been applied to the forward socket portion 110 to secure the wires 200 in place within the socket. The crimps 115 extend radially around the forward portion 110 of the holder and across the seam 113 which is now closed (the sides 112, 114 now abut) due to the crimping.

Within the die at the die station E, a removable pin (not shown) is inserted into the rear portion of the forward socket 110 to provide a rear stop for the wires being inserted from the forward end. After the crimps 115 secure the wires 200 in place within the socket, the pin can be removed.

The wires 200 are preferably secured together at the rear ends thereof to form a one-piece bundle. One such method of securing the wires into the bundle is described in the Welded Brush Contact Patent.

At the die position F, the forward portion 110 has been crimped with an an additional crimp 116 to provide additional holding of the wires 200 within forward portion of the socket 110.

At the position G, the forward end of portion 110 has yet another crimp 117 which "sizes" the forward end of the holder to the approximate circumference of the bundle of axially-aligned wires 200 when the wires are tightly packed. The holder is "sized" to provide a tighter fit of the wires 200 and bring each of the wires 200 into better alignment with each other and the axis of the socket.

Also at the die position G, an insulated wire may be positioned within the rear portion 130 of the holder 100. In the forward portion of the wire 300, insulation has been removed to expose the bare conductor 310. The bare conductor 310 extends generally in the region of the rear portion 130 which at this stage of manufacturing is trough shaped and will become subsequently the rear socket upon completion of the forming. The conductor or wire 300 has insulation 320 in the portion which is in the region of the insulation-retaining portion 140.

The wire 300 is preferably inserted with the trough formed by sides 132, 134 by positioning the wire above the trough with its axis aligned with the trough, then moving the wire down into the trough. Such an insertion of the wire is advantageous in that it can be accomplished with automated equipment. Further, the trough guides the wire down into a proper position.

Typically, the insulated wire 300 is inserted into the trough 130 and secured in place by the user after the forward portion of the contact has been completely manufactured and assembled by the manufacturer. Thus, the explanation of the use of the conductor 300 is for clarity and completeness only in understanding the environment of the present invention.

If the wire 300 is to be inserted manually, the rear socket 130 might be completely formed prior to insertion. The axis of the wire 300 would then be aligned with the axis of the socket 130. The wire would be moved in translation along the common axis for insertion.

At the die position H, the sides 132, 134 of the portion 130 and the portions 142, 144 have been formed up and over the wire 300. The sides 132, 134 of the portion 130 (now crimped over the conductor) provide an electrical and mechanical connection to the bare conductor 310; the portions 142, 144 retain the insulated conductor 300 as the portions 142, 144, which are crimped around the wire, grip the insulation 320 and provide mechanical strain relief to protect the electrical coupling of the sides 132, 134 to the bare conductor 310.

FIG. 3 is a cross sectional view of the holder portion 110 at the die position B. It shows the holder portion 110 at its stage of completion at this position which is with the sides 112, 114 bent upward, the outer edges of which extend approximately perpendicular to the carrier strip (not shown) and the originally flat, stamped piece. The cross-section of the holder is now in the shape of the letter "U".

FIG. 4 is a cross-sectional view of the holder portion 110 at the die position C. It shows the holder portion 110 at its stage of completion at this position which is with the outer edges of the sides 112, 114 bent inward toward each other in a partial circular shape. The cross-section of the holder is now in the shape of the letter "C".

FIG. 5 is a cross-sectional view of the holder at the die position D. It shows the holder portion 110 at its stage of completion at this position which is with the outer edges of the sides 112, 114 positioned almost adjacent to each other at the open seam 113 to form a sleeve. The cross-section of the holder is now substantially in the shape of the letter "O" with a small hiatus at the open seam 113.

FIG. 6 is a cross-sectional view of the holder at the die position F. It shows the holder portion 110 at its stage of completion at this position which is with a plurality of wires 200 held relatively loosely within the holder by the sides 112, 114.

FIG. 7 is a cross-sectional view of the holder at the die position G. It shows the holder portion 110 at its stage of completion at this position which is with the wires 200 held within the socket 110 more tightly than FIG. 6, by virture of the "sizing" of the socket to the circumference of the wires.

FIG. 8 is a cross-sectional view of the rear socket 130 holder at the die position H. It shows the conductor 300 held within the rear socket 130 by a "B-type" crimp of the sides 132, 134. This type of crimp, which is well known in the art, looks like the letter "B" in its cross-section, as shown in this view.

FIG. 9 illustrates a perspective view of an electrical contact of the present invention before an electrical conductor is attached. The contact includes the holder forward portion or socket 110 with axially aligned wires 200, each having angled end surfaces 210, extending from the forward end of the holder. A plurality of crimps 115, 116, 117 secure the wires within the holder forward socket 110. The medial necked down portion 120 connects the forward socket 110 with the rear trough 130, which is empty and not formed into a socket. The insulation gripping portions 142,144 are shown.

The contact 100, as shown in FIG. 9, has been severed from the carrier strip and the carrier strip attachment has been trimmed from the contact as well. Typically, the contact would not be separated from the carrier strip and the carrier strip attachment until the electrical conductor had been attached if it was desired to mechanically couple the conductor to the contact. Also, the attachment of the contacts the carrier strip presents a simple way to handle a plurality of contacts simultaneously. The uniform orientation of the contacts with respect to the carrier strip and uniform spacing between successive contacts on the carrier strip facilitates mechanical or automated handling.

FIG. 10 shows an alternative embodiment or configuration of the stamped holder of FIG. 1. A stamped holder 400, in a flat, essentially one-dimensional form, is shown. The portions 120, 130, 140 and 150 may be identical to the respective portions shown in FIG. 1. A forward enlarged portion 410, which will become the forward wire-retaining socket when it is formed into its three-dimensional shape, includes portions 411, 412, 413, 414,415, 416. The medial portions 412, 415 are laterally offset from the respective forward portions 411, 414 and rear portions 413,416. When the forward socket is formed, the seam of the meeting sides is offset.

FIG. 11 shows a partial front view of the holder of FIG. 10 formed into a three-dimensional piece. Brush wires 200 (partially shown) extend from the forward socket 410. The portions 411, 412, 413 meet the respective portions 414, 415, 416 at a seam 417 which includes a laterally-offset medial portion. The laterally-offset seam 417, in contrast to the straight seam 113 of the embodiment of FIGS. 2–9, provides added assurance that one of the wires 200 will not slip through the seam. In many applications, the crimping of the forward portion alone is sufficient to retain the wires securely within the holder. As an alternative method of making the present contact in place of the welded bundle, a plurality of individual thin, axially aligned contact wires might be used. In such a case, the seam 113 (shown at the die position D in FIG. 2) would probably have to be closed (or substantially closed) in order to retain the individual wires within the socket. The plurality of fine, axially aligned wires used in such an alternate embodiment are preferably individual strands which are funneled into the forward socket 110, with the rear portion of the forward socket including suitable means for stopping the wires at a desired depth.

A sleeve may be applied over the contact brush wires to protect the wires. Such a sleeve would extend forwardly and outside of the axially aligned wires.

Other objects and advantages of the present invention will be apparent to those skilled in the art in view of the foregoing description. For example, the sides of the seam could overlap or the seam might be welded (or both). The wires might be secured or retained within the holder in additional or alternative manners, such as being soldered in place within the socket in addition to or in place of the disclosed crimping. Also, other rear portions of the holder, such as a solderless-wrap or printed circuit board tail, might be advantageous for receiving a conductor in certain applications. In some instances, the rear portion of the contact may be a solder tab and may not require an enlarged rear portion or any forming. The die sequence shown could also be altered to fit the manufacturing requirements, as what is shown as one step could be expanded into several steps and what is shown as several steps and might be combined as one. Blank or idle die stations might be advantageous in some instances. The foregoing description accordingly should be considered as illustrative only and should not interpreted to limit the scope of the present invention, which is defined by the following claims.

What is claimed is:

1. A method of making a hermophroditic electrical contact comprising the steps of:

stamping a contact body as a single flat piece of electrically conducting stock having uniform thickness and including forward and rear portions, said stamping of the forward portion including stamping the forward portion into a generally rectangular portion having interfitting side edges;

forming the forward portion of the contact body into a generally cylindrically-shaped socket by progressively bending the edges around to a position where the interfitting edges form a seam;

inserting a plurality of fine parallel contact wires into the forward socket of the contact body; and crimping the foward portion of the contact body at a first location near the rear end thereof to retain the wires therein and at a second location longitudinally forward of the first location, said crimping at a plurality of spaced locations for axially aligning said contact wires with each other and the socket.

2. A method of making an electrical contact comprising the steps of:

stamping a contact body as a single flat piece of electrically conducting stock having uniform thickness and including forward and rear portions, said stamping of the forward portion including stamping the forward portion into a generally rectangular portion having a lateral offset along one side and a complementary lateral projection along the other side;

forming the forward portion of the contact body into a generally cylindrically-shaped socket by progressively bending the edges around to a position where the edges adjoin at a first seam with the lateral projection interfitting within the lateral offset at a seam portion which is circumferentially offset from the first seam;

inserting a plurality of fine contact parallel wires into the forward socket of the contact body; and crimping the forward portion of the socket of the contact body at a first location near the rear end thereof to retain the wires therein.

3. A method of making a hermophroditic electrical contact comprising the steps of:

stamping a contact body as a single flat piece of electrically conducting stock having uniform thickness and including forward and rear portions, said stamping of the forward portion including stamping the forward portion into a generally rectangular portion having a lateral offset along one side and a complementary lateral projection along the other side;

forming the forward portion of the contact body into a generally cylindrically-shaped socket by progressively bending the edges around to a position where the edges adjoin at a first seam with the lateral projection interfitting within the lateral offset at a seam portion which is circumferentially offset from the first seam;

inserting a plurality of fine contact parallel wires into the forward socket of the contact body; and crimping the forward portion of the socket of the contact body at a first location near the rear end thereof to retain the wires therein and at a second location longitudinally forward of the first location, said crimping at two longitudinally spaced locations for axially aligning said contact wires with each other and the socket.

4. A method of making an electrical contact as described in claim 3 wherein the step of crimping additionally includes forming a crimp at the forward end of the socket to make the forward end of the socket approximately the diameter of the plurality of contact wires.

5. A method of making a contact as described in claim 4 wherein the method includes the steps of forming the rear portion of the contact body into a trough-like shape having conductor receiving members and insulation-receiving portions.

6. A method of making a mateable hermaphroditic electrical contact comprising the steps of:

stamping a contact body from a flat piece of electrically conducting stock, said stamping providing the flat piece with a generally rectangular forward portion having oppositely disposed first and second sides, each of said sides having therealong a laterally offset portion;

forming the rectangular forward portion of the flat piece into a contact body having a generally cylindrically-shaped socket by progressively bending the sides around to a position where the sides adjoin at a seam and the laterally offset portions interfit;

arranging several pieces of conductive wire in parallel relationship;

inserting one end of the wires into the socket exposing the other end of the wires for mating; and crimping at least a portion of the cylindrically-shaped socket to retain the wires therein, whereby the retained and aligned wires and the cylindrically-shaped socket provide the mateable hermaphroditic electrical contact.

7. A method of making an electrical contact as recited in claim 6 wherein the step of crimping includes forming at least two longitudinally spaced apart crimps.

8. A method of making an electrical contact as recited in claim 7 wherein the step of crimping additionally includes forming a crimp at the forward end of the socket to make the forward end of the socket approximately the diameter of the plurality of contact wires.

* * * * *